US007606703B2

(12) United States Patent
Unno

(10) Patent No.: US 7,606,703 B2
(45) Date of Patent: Oct. 20, 2009

(54) LAYERED CELP SYSTEM AND METHOD WITH VARYING PERCEPTUAL FILTER OR SHORT-TERM POSTFILTER STRENGTHS

(75) Inventor: Takahiro Unno, Richardson, TX (US)

(73) Assignee: Texas Instruments Incorporated, Dallas, TX (US)

( * ) Notice: Subject to any disclaimer, the term of this patent is extended or adjusted under 35 U.S.C. 154(b) by 1543 days.

(21) Appl. No.: 10/054,604

(22) Filed: Nov. 13, 2001

(65) Prior Publication Data

US 2002/0107686 A1 Aug. 8, 2002

Related U.S. Application Data

(60) Provisional application No. 60/248,988, filed on Nov. 15, 2000.

(51) Int. Cl.
*G20L 19/00* (2006.01)

(52) U.S. Cl. ..... 704/219; 704/223

(58) Field of Classification Search ..... 704/219, 704/223

See application file for complete search history.

(56) References Cited

U.S. PATENT DOCUMENTS 4,969,192 A * 11/1990 Chen et al. ..... 704/222
5,495,555 A * 2/1996 Swaminathan ..... 704/207
5,657,420 A * 8/1997 Jacobs et al. ..... 704/223
5,751,901 A * 5/1998 DeJaco et al. ..... 704/216
5,845,244 A * 12/1998 Proust ..... 704/200.1
5,913,187 A * 6/1999 Mermelstein ..... 704/219
6,052,659 A * 4/2000 Mermelstein ..... 704/219
6,182,030 B1 * 1/2001 Hagen et al. ..... 704/201
6,260,017 B1 * 7/2001 Das et al. ..... 704/265
6,324,505 B1 * 11/2001 Choy et al. ..... 704/230
6,397,178 B1 * 5/2002 Benyassine ..... 704/230
6,449,592 B1 * 9/2002 Das ..... 704/224
6,470,317 B1 * 10/2002 Ladd et al. ..... 704/275
6,928,406 B1 * 8/2005 Ehara et al. ..... 704/223
6,961,698 B1 * 11/2005 Gao et al. ..... 704/229

* cited by examiner

*Primary Examiner*—Michael N. Opsasnick
(74) *Attorney, Agent, or Firm*—Mirna G. Abyad; Wade J. Brady, III; Frederick J. Telecky, Jr.

(57) ABSTRACT

Layered code-excited linear prediction (CELP) speech encoders have progressively weaker perceptual weighting filters for each of the successive enhancement layers and decoders have progressively weaker short-term postfilters for increased bit rates (increased number of enhancement layers decoded) and a long-term postfilter for all bit rates.

2 Claims, 4 Drawing Sheets

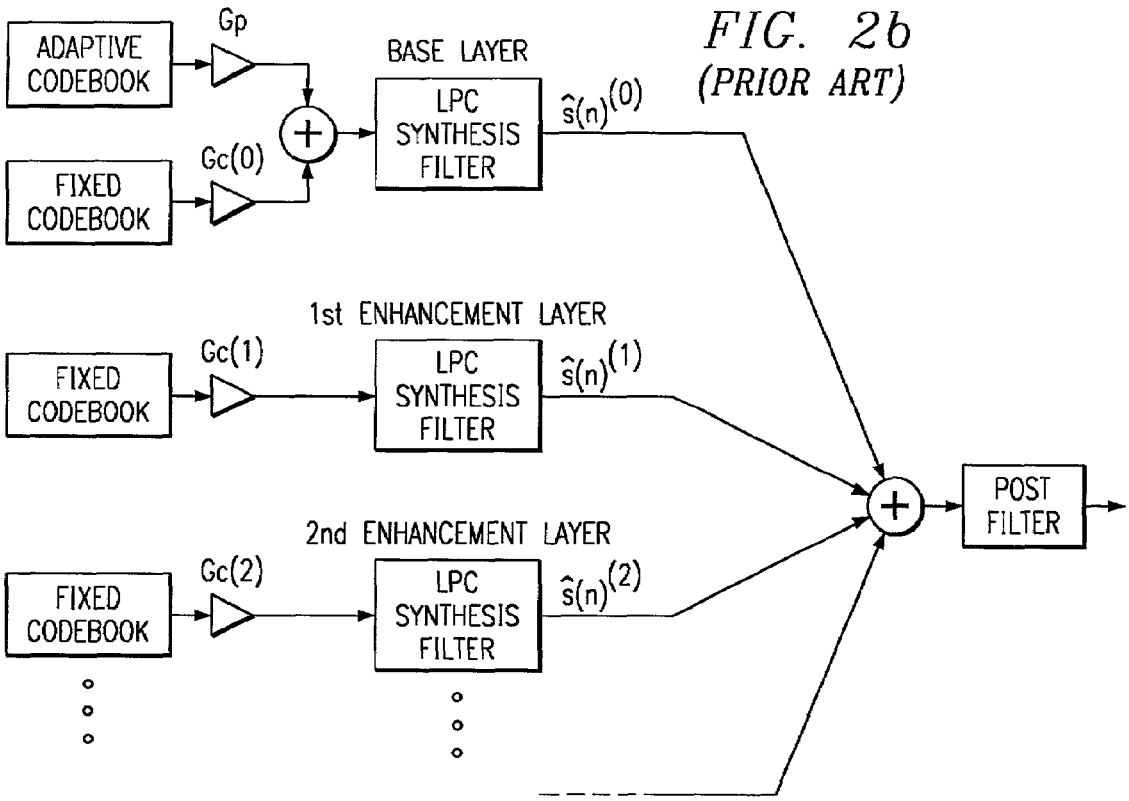
FIG. 2b
(PRIOR ART)
FIG. 3a
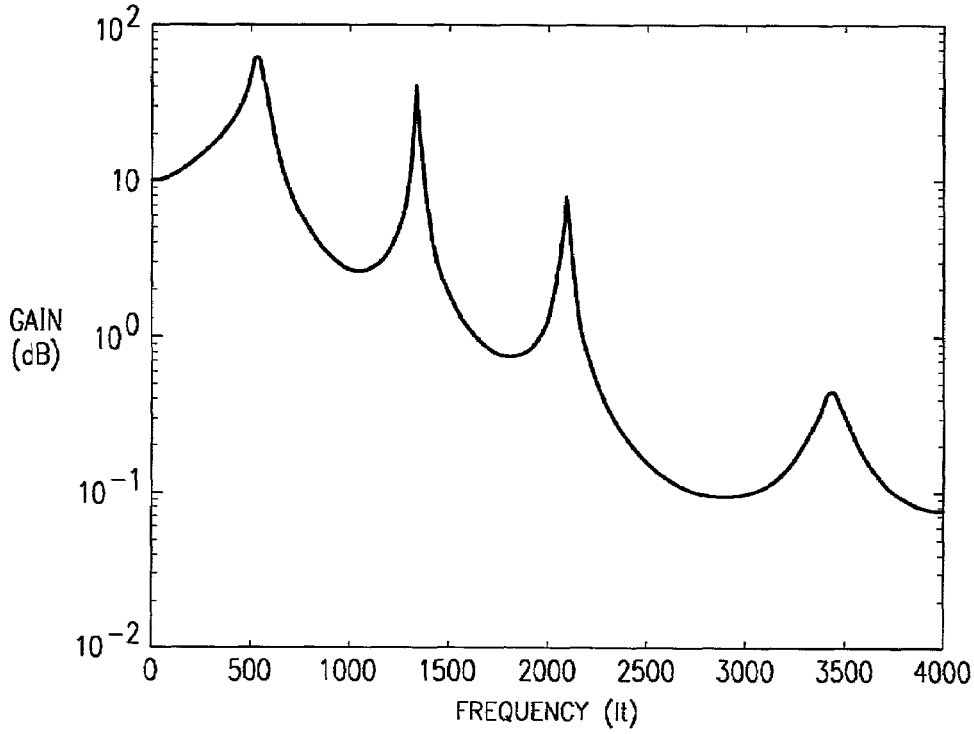

LAYERED CELP SYSTEM AND METHOD WITH VARYING PERCEPTUAL FILTER OR SHORT-TERM POSTFILTER STRENGTHS

CROSS-REFERENCE TO RELATED APPLICATIONS

This application claims priority from provisional application: Ser. No. 60/248,988, filed Nov. 15, 2000, which is incorporated herein by reference.

BACKGROUND OF THE INVENTION

The invention relates to electronic devices, and more particularly to speech coding, transmission, storage, and decoding/synthesis methods and circuitry.

The performance of digital speech systems using low bit rates has become increasingly important with current and foreseeable digital communications. Both dedicated channel and packetized-over-network (e.g., Voice over IP or Voice over Packet) transmissions benefit from compression of speech signals. The widely-used linear prediction (LP) digital speech coding compression method models the vocal tract as a time-varying filter and a time-varying excitation of the filter to mimic human speech. Linear prediction analysis determines LP coefficients $a_i$, i=1, 2, . . . , M, for an input frame of digital speech samples {s(n)} by setting $$r(n)=s(n)+\Sigma_{M\geqq i\geqq 1}a_i s(-i) \quad (1)$$

and minimizing the energy $\Sigma r(n)^2$ of the residual r(n) in the frame. Typically, M, the order of the linear prediction filter, is taken to be about 10-12; the sampling rate to form the samples s(n) is typically taken to be 8 kHz (the same as the public switched telephone network sampling for digital transmission); and the number of samples {s(n)} in a frame is typically 80 or 160 (10 or 20 ms frames). A frame of samples may be generated by various windowing operations applied to the input speech samples. The name "linear prediction" arises from the interpretation of $r(n)=s(n)+\Sigma_{M\geqq i\geqq 1} a_i s(n-i)$ as the error in predicting s(n) by the linear combination of preceding speech samples $-\Sigma_{M\geqq i\geqq 1} a_i s(n-i)$. Thus minimizing $\Sigma r(n)^2$ yields the $\{a_i\}$ which furnish the best linear prediction for the frame. The coefficients $\{a_i\}$ may be converted to line spectral frequencies (LSFs) for quantization and transmission or storage and converted to line spectral pairs (LSPs) for interpolation between subframes.

The {r(n)} is the LP residual for the frame, and ideally the LP residual would be the excitation for the synthesis filter 1/A(z) where A(z) is the transfer function of equation (1). Of course, the LP residual is not available at the decoder; thus the task of the encoder is to represent the LP residual so that the decoder can generate an excitation which emulates the LP residual from the encoded parameters. Physiologically, for voiced frames the excitation roughly has the form of a series of pulses at the pitch frequency, and for unvoiced frames the excitation roughly has the form of white noise.

The LP compression approach basically only transmits/stores updates for the (quantized) filter coefficients, the (quantized) residual (waveform or parameters such as pitch), and (quantized) gain(s). A receiver decodes the transmitted/stored items and regenerates the input speech with the same perceptual characteristics. Periodic updating of the quantized items requires fewer bits than direct representation of the speech signal, so a reasonable LP coder can operate at bits rates as low as 2-3 kb/s (kilobits per second). In more detail, the ITU standard G.729 uses frames of 10 ms length (80 samples) divided into two 5-ms 40-sample subframes for better tracking of pitch and gain parameters plus reduced codebook search complexity. Each subframe has an excitation represented by an adaptive-codebook contribution plus a fixed (algebraic) codebook contribution, and thus the name CELP for code-excited linear prediction. The adaptive-codebook contribution provides periodicity in the excitation and is the product of v(n), the prior frame's excitation translated by the current frame's pitch lag in time and interpolated, multiplied by a gain, $g_P$. The algebraic codebook contribution approximates the difference between the actual residual and the adaptive codebook contribution with a four-pulse vector, c(n), multiplied by a gain, $g_C$. Thus the excitation is $u(n)=g_P v(n)+g_C c(n)$ where v(n) comes from the prior (decoded) frame and $g_P$, $g_C$, and c(n) come from the transmitted parameters for the current frame. The speech synthesized from the excitation is then postfiltered. to mask noise. Postfiltering essentially comprises three successive filters: a short-term filter, a long-term filter, and a tilt compensation filter. The short-term filter emphasizes the formants; the long-term filter emphasizes periodicity, and the tilt compensation filter compensates for the spectral tilt typical of the short-term filter.

Further, as illustrated in FIGS. 2*a*-2*b* a layered coding such as the MPEG-4 audio CELP encoder/decoder provides bit rate scalability with an output bitstream consisting of a base layer (adaptive codebook together with fixed codebook 0) plus N enhancement layers (fixed codebooks 1 through N). A layered encoder uses only the base layer at the lowest bit rate to give acceptable quality and provides progressively enhanced quality by adding progressively more enhancement layers to the base layer. This layering is useful for some voice over packet (VoP) applications including different Quality of Service (QoS) offerings, network congestion control, and multicasting. For the different QoS service offerings, a layered coder can provide several options of bit rate by increasing or decreasing the number of enhancement layers. For the network congestion control, a network node can strip off some enhancement layers and lower the bit rate to ease network congestion. For multicasting, a receiver can retrieve appropriate number of bits from a single layer-structured bitstream according to its connection to the network.

CELP coders apparently perform well in the 6-16 kb/s bit rates often found with VoIP transmissions. However, known CELP coders perform less well at higher bit rates in a layered coding design, probably because the transmitter does not know how many layers will be decoded at the receiver.

SUMMARY OF THE INVENTION

The present invention provides a layered CELP coding with one or more filterings: progressively weaker perceptual filtering in the encoder, progressively weaker short-term postfiltering in the decoder, and pitch postfiltering for all layers in the decoder.

This has advantages including achieving non-layered quality with a layered CELP coding system.

BRIEF DESCRIPTION OF THE DRAWINGS

FIGS. 2*a*-2*b* illustrate a layered CELP encoder and decoder.

FIGS. 3*a*-3*c* show filter spectra.

DETAILED DESCRIPTION OF THE PREFERRED EMBODIMENTS

1. Overview

Figure 1:
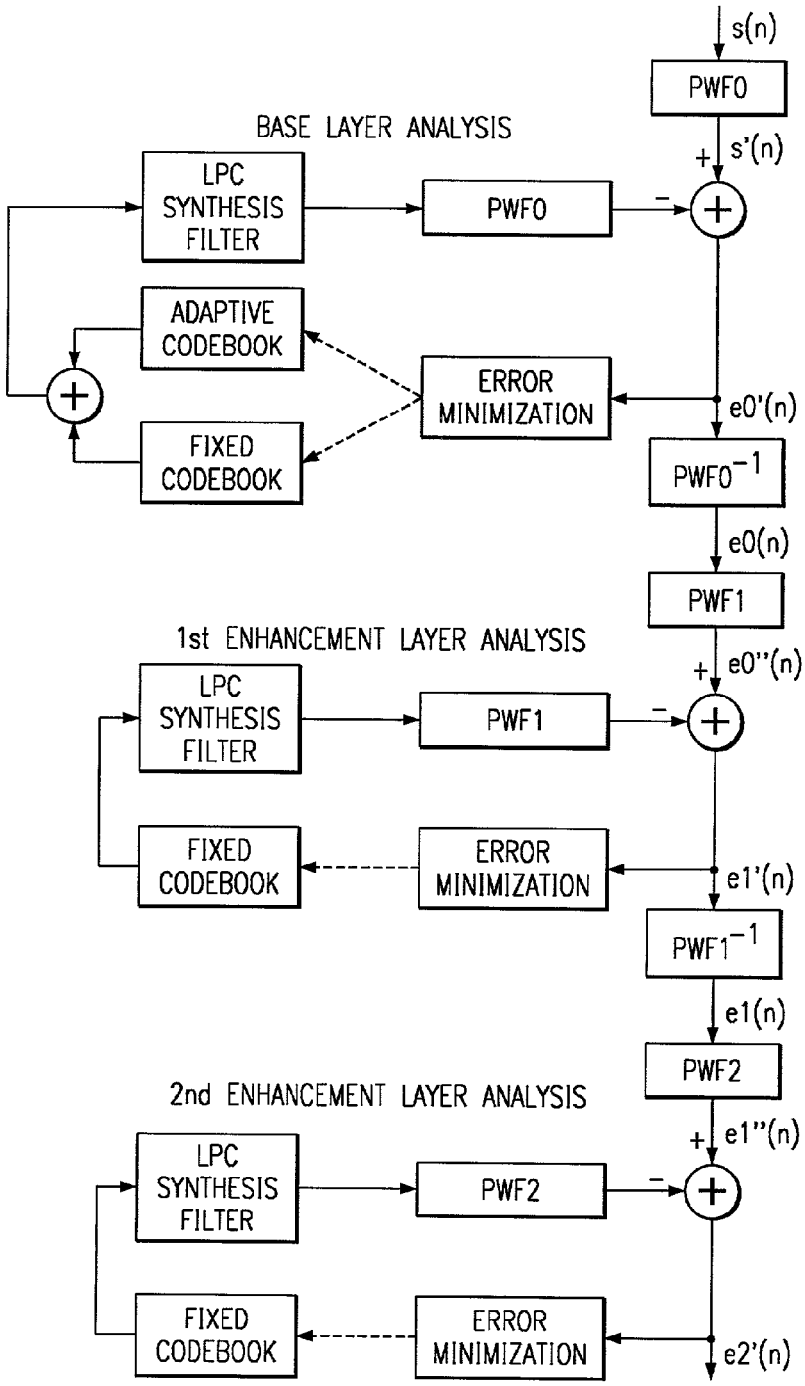
FIG. 1 shows a preferred embodiment encoder.

The preferred embodiment systems include preferred embodiment encoders and decoders which use layered CELP coding with one or more of three filterings: progressively weaker perceptual filtering in the encoder for enhancement layer codebook searches, progressively weaker short-term postfiltering in the decoder for successively higher bit rates, and decoder long-term postfiltering for all layers. FIG. 1 illustrates an encoder with progressively weaker perceptual filtering in the enhancement layers.

2. Encoder Details

Figure 2A:
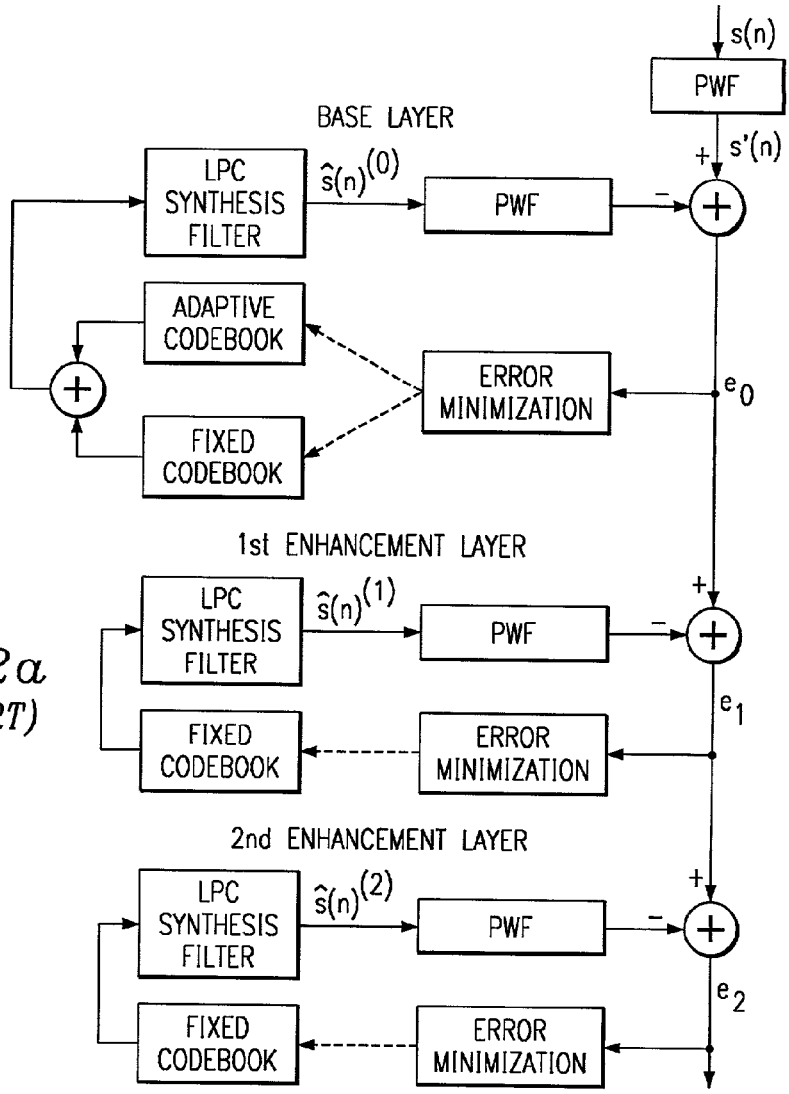
FIG. 2a (PRIOR ART)

First consider a layered CELP encoder with more detail in order to explain the preferred embodiment filters. FIGS. 2*a*-2*b* illustrates the MPEG-4 layered CELP audio encoder and decoder. The base layer (layer 0) has the same structure as a non-layered CELP encoder and decoder: the LPC parameters are analyzed with an open loop and the adaptive and fixed (algebraic) codebooks are searched with closed loop analysis-by-synthesis methods. In each enhancement layer only the fixed codebook parameters (pulse positions and gain) are analyzed with the analysis-by-synthesis method using an error signal from the lower layers as an input signal.

In more detail, a preferred embodiment includes the following steps.

(1) Sample an input speech signal (which may be preprocessed to filter out dc and low frequencies, etc.) at 8 kHz or 16 kHz to obtain a sequence of digital samples, s(n). Partition the sample stream into 80-sample or 160-sample frames (e.g., 10 ms frames) or other convenient frame size. The analysis and coding may use various size subframes of the frames.

(2) For each frame (or subframes) apply linear prediction (LP) analysis to find LP (and thus LSF/LSP) coefficients and thereby also define the LPC synthesis filter $1/A(z)$. Quantize the LSP coefficients for transmission; this also defines the quantized LPC synthesis filter $1/\hat{A}(z)$. The same synthesis filter will be used for all enhancement layers in addition to the base layer. Note that the roots of $A(z)=0$ are within the complex unit circle and correspond to formants (peaks) in the spectrum of the synthesis filter. LP analysis typically uses a windowed version of s(n).

(3) Perceptually filter the speech s(n) with the perceptual weighting filter (PWF) defined by $W(z)=A(z/\gamma_1)/A(z/\gamma_2)$ to yield s'(n). This filtering masks quantization noise by shaping the noise to appear near formants where the speech signal is stronger and thereby give better results in the error minimization which defines the estimation. The parameters $\gamma_1$ and $\gamma_2$ determine the level of noise masking ($1 \geqq \gamma_1 \geqq \gamma_2 > 0$). In general, a low bit rate CELP encoder uses the PWF with stronger noise masking (e.g., $\gamma_1=0.9$ and $\gamma_2=0.5$) while a high bit rate CELP encoder uses a PWF with weaker noise masking (e.g., $\gamma_1=0.9$ and $\gamma_2=0.65$). As FIG. 2*a* shows, the MPEG-4 layered CELP encoders apply the same PWF in each layer. Using the same PWF in each layer provides optimal noise masking at some bit rates, but it is not optimal for some other bit rates. Indeed, the MPEG-4 CELP encoder uses strong noise masking for all bit rates; as a result, it provides speech with a muffled quality even at higher bit rates.

In contrast, the first preferred embodiments progressively weaken the PWF from layer to layer as illustrated in FIG. 1. In fact, the base layer uses PWF0 which is stronger than PWF1 used in layer 1 which, in turn, is stronger than PWF2 used in layer 2, and so forth. Thus the strongest noise masking occurs for the lowest bit rate base layer, and increased bit rates permit enhancement layers to have weaker noise masking. Step (7) details the PWFs. Note that the particular PWFs used does not affect the decoder (see FIG. 2*b*), but rather only impacts the accuracy of the estimations (excitation components) generated in the encoder.

(4) Find a pitch delay (for the base layer) by searching correlations of s'(n) with s'(n+k) in a windowed range. The search may be in two stages: first perform an open loop search using correlations of s'(n) to find a pitch delay. Then perform a closed loop search to refine the pitch delay by interpolation from maximizations of the normalized inner product $\langle x|y_k\rangle$ of the target speech x(n) in the (sub)frame with the speech $y_k(n)$ generated by applying the (sub)frame's quantized LP synthesis filter and PWF to the prior (sub)frame's base layer excitation delayed by k. The target x(n) is s'(n) minus the 0 response of the quantized LP synthesis filter plus PWF. The adaptive codebook vector v(n) is then the prior (sub)frame's base layer excitation ($u_{prior}(n)$) translated by the refined pitch delay and interpolated. The same adaptive codebook vector applies to all enhancement layers in the sense that the enhancement layers only add to the fixed codebook contribution to the excitation. Thus the decoder will generate an excitation $u(n)$ as $g_P\, v(n)+g_{C0}\, c_0(n)+g_{C1}\, c_1(n)+\ldots$ where $g_P$ is the adaptive codebook gain, $g_{Cj}$ is the j layer fixed codebook gain, and $c_j(n)$ is the j layer fixed codebook vector.

(5) Determine the adaptive codebook gain, $g_P$, as the ratio of the inner product $\langle x|y\rangle$ divided by $\langle y|y\rangle$ where x(n) is the target in the (sub)frame and y(n) is the (sub)frame signal generated by applying the quantized LP synthesis filter and then PWF to the adaptive codebook vector v(n) from step (4). Thus $g_P v(n)$ is the adaptive codebook contribution to the excitation and $g_P y(n)$ is the adaptive codebook contribution to the speech in the (sub)frame.

(6) Find the base layer (layer 0) fixed (algebraic) codebook vector $c_0(n)$ by essentially maximizing the correlation of $c_0(n)$ filtered by the quantized LP synthesis filter and then PWF with $x(n)-g_P y(n)$ as the target in the (sub)frame. That is, remove the adaptive codebook contribution to have a new target. In particular, search over possible algebraic codebook vectors $c_0(n)$ to maximize the ratio of the square of the correlation $\langle x-g_p y|H|c\rangle$ divided by the energy $\langle c|H^T H|c\rangle$ where h(n) is the impulse response of the quantized LP synthesis filter (with perceptual filtering) and H is the lower triangular Toeplitz convolution matrix with diagonals h(0), h(1), . . . .

The preferred embodiments use fixed codebook vectors c(n) with 40 positions in the case of 40-sample (5 ms for 8 kHz sampling rate) (sub)frames as the encoding granularity. The 40 samples are partitioned into two interleaved tracks with 1 pulse (which is ±1) positioned within each track. For the base layer each track has 20 samples; whereas for the enhancement layers each track has 8 samples and the tracks are offset. That is, with the 40 positions labeled 0,1,2, . . . ,39, layer 1 has tracks {0,5,10, . . . 35} and {1,6,11 , . . . 36}; layer 2 has tracks {2,7,12, . . . 37} and {3,8,13, . . . 38}, and so forth with rollover.

(6) Determine the base layer fixed codebook gain, $g_{C0}$ by minimizing $|x-g_P y-g_{C0} z_0|$ where, as in the foregoing description, x(n) is the target in the (sub)frame, $g_P$ is the adaptive codebook gain, y(n) is the quantized LP synthesis filter plus PWF applied to v(n), and $z_0(n)$ is the signal in the frame generated by applying the quantized LP synthesis filter plus PWF to the algebraic codebook vector $c_0(n)$.

As FIG. 1 shows, the error minimized to find the parameters (gains and fixed codebook vector) for the base layer (layer 0) is e0'(n) which is the PWF filtered difference between the input speech s(n) and the output $\hat{s}^{(0)}(n)$ of the LP synthesis filter of the layer 0 excitation $g_P\ v(n)+g_{C0}\ c_0(n)$.

(7) Sequentially, determine enhancement layer fixed codebook vectors and gains as illustrated in FIG. 1. Let the PWF for the nth enhancement layer (with the 0th layer being the base layer) be denoted PWFn, then the preferred embodiment progressively weakening PWF has PWF0 stronger than PWF1, which is stronger than PWF2, and so forth. In other words, $\gamma_{01}/\gamma_{02} \geqq \gamma_{11}/\gamma_{12} \geqq \ldots \geqq \gamma_{n1}/\gamma_{n2} \geqq 1$ where $\gamma_{k1}$ and $\gamma_{k2}$ are the $\gamma_1$ and $\gamma_2$ for the kth layer. This progressively weaker PWF allows the layered CELP coder to provide optimal noise masking at each bit rate and a less muffled speech at higher bit rates. For example, the following table shows preferred embodiment $\gamma_1$ and $\gamma_2$ dependence on bit rates where layer 0 requires 6.25 kbps and each enhancement layer above layer 0 requires another 2.2 kbps:

| bitrate | $\gamma_1$ | $\gamma_2$ |
|---|---|---|
| 6.25 | 0.9 | 0.5 |
| 8.75 | 0.9 | 0.5 |
| 10.65 | 0.9 | 0.55 |
| 12.85 | 0.9 | 0.6 |
| 15.05 | 0.9 | 0.65 |
| 17.25 | 0.9 | 0.65 |

Figure 3B:
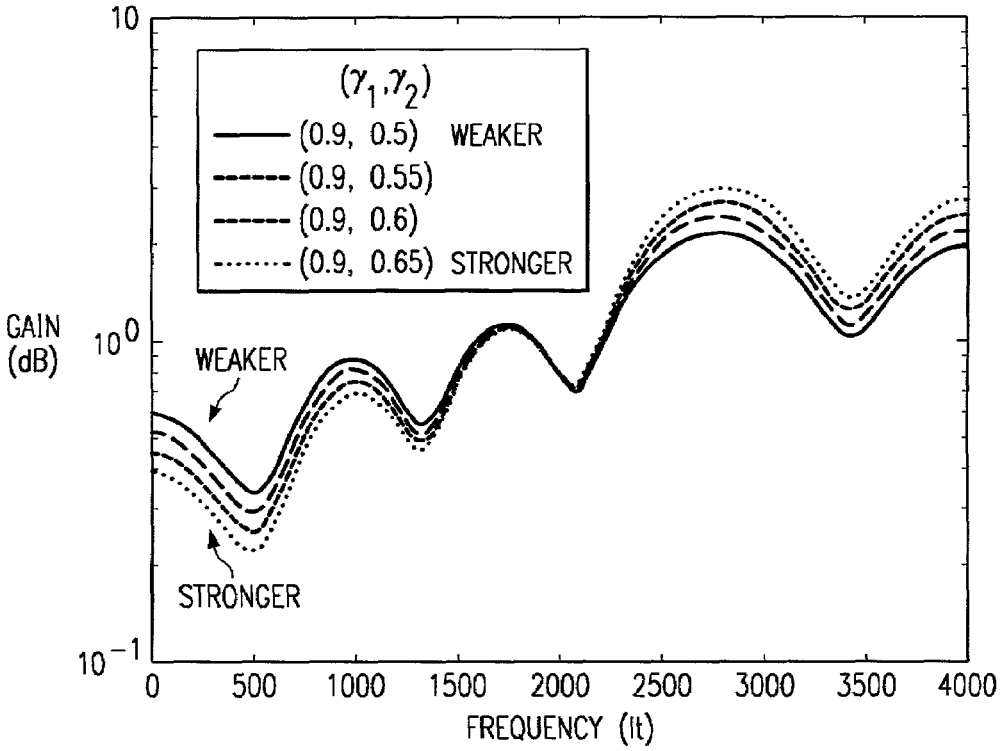

FIGS. 3*a*-3*b* illustrate the filtering. In particular, FIG. 3*a* shows the magnitude of an example 1/A(z) for |z|=1 which corresponds to real frequencies, and FIG. 3*b* shows the corresponding PWFs for the above table. Note that a weaker PWF suppresses large 1/A(z) less and emphasizes small 1/A(z) less than a stronger filter.

In more detail, denote by $\hat{s}^{(0)}(n)$ the output of the LP synthesis filter applied to the layer 0 excitation, $g_P\ v(n)+g_{C0}\ c_0(n)$. Thus $\hat{s}^{(0)}(n)$ estimates the original signal s(n) but was derived from minimizing the error $e0'=PWF0[s(n)-\hat{s}^{(0)}(n)]$; that is, minimizing the difference of perceptually weighted versions of the original signal and the LP synthesis filter output. And the strength of PWF0 depends upon the bit rate of the base layer.

For the first enhancement layer the total bit rate is greater than that of the base layer alone, so apply less perceptual weighting to difference being minimized during the fixed codebook 1 search. In particular, the total excitation for layers 0 plus 1 is $g_P\ v(n)+g_{C0}\ c_0(n)+g_{C1}\ c_1(n)$ and thus the total estimate for s(n) output by the LP synthesis filter is $\hat{s}^{(0)}(n)+\hat{s}^{(1)}(n)$ where $\hat{s}^{(1)}(n)$ is the output of the LP synthesis filter applied to the layer 1 fixed codebook 1 excitation contribution $g_{C1}\ c_1(n)$. Thus minimize the error $e1'=PWF1[s(n)-\hat{s}^{(0)}(n)-\hat{s}^{(1)}(n)]$ where PWF1 is perceptual weighting filter for layer 1. Now as FIG. 1 illustrates:

$$e1'(n) = PWF1[s(n) - \hat{s}^{(0)}(n) - \hat{s}^{(1)}(n)]$$

$$= PWF1[s(n) - \hat{s}^{(0)}(n)] - PWF1[\hat{s}^{(1)}(n)] \text{ because filtering is linear}$$

$$= PWF1[e0(n)] - PWF1[\hat{s}^{(1)}(n)] \text{ where } e0(n) = s(n) - \hat{s}^{(0)}(n)$$

$$= PWF1[PWF0^{-1}[e0'(n)]] - PWF1[\hat{s}^{(1)}(n)] \text{ where } PWF0^{-1} \text{ is the inverse filter of } PWF0 \text{ and } e0'(n) = PWF0[e0(n)]$$

Analogous to the foregoing description of the first enhancement layer, for the second enhancement layer the total bit rate is greater than that of the first plus base layers, so apply even less perceptual weighting to the difference being minimized during the fixed codebook 2 search. In particular, the total excitation for layers 0 plus 1 plus 2 is $g_P\ v(n)+g_{C0}\ c_0(n)+g_{C1}\ c_1(n)+g_{C2}\ c_2(n)$ and thus the total estimate for s(n) output by the LP synthesis filter is $\hat{s}^{(0)}(n)+\hat{s}^{(1)}(n)+\hat{s}^{(2)}(n)$ where $\hat{s}^{(2)}(n)$ is the output of the LP synthesis filter applied to the layer 2 fixed codebook 2 excitation contribution $g_{C2}\ c_2(n)$. Thus minimize the error $e2'=PWF2[s(n)-\hat{s}^{(1)}(n)-\hat{s}^{(1)}(n)-\hat{s}^{(2)}(n)]$ where PWF2 is the perceptual weighting filter for layer 2. Similarly for higher enhancement layers and perceptual filters.

The LP synthesis filter is the same for all enhancement layers.

(8) Quantize the adaptive codebook pitch delay and gain $g_P$ and the fixed (algebraic) codebook vectors $c_0(n)$, $c_1(n)$, $c_2(n)$, . . . and gains $g_{c0}, g_{c1}, g_{c2}, g_{c3}, \ldots$ to be parts of the layered transmitted codeword. The algebraic codebook gains may factored and predicted, and the two layer 0 gains may be jointly quantized with a vector quantization codebook. The layer 0 excitation for the (sub)frame is $u(n)=g_p v(n)+g_{c0}c_0(n)$, and the excitation memory is updated for use with the next (sub)frame.

Note that all of the items quantized typically would be differential values with the preceding frame's values used as predictors. That is, only the differences between the actual and the predicted values would be encoded.

The final codeword encoding the (sub)frame would include bits for the quantized LSF/LSP coefficients, quantized adaptive codebook pitch delay, algebraic codebook vectors, and the quantized adaptive codebook and algebraic codebook gains.

3. Decoder Details

A first preferred embodiment decoder and decoding method essentially reverses the encoding steps for a bitstream encoded by the preferred embodiment layered encoding method and also applies preferred embodiment short-term postfiltering and preferred embodiment long-term postfiltering. In particular, for a coded (sub)frame in the bitstream presume layers 0 through N are being used for the (sub)frame:

(1) Decode the quantized LP coefficients; these are in layer 0 and always present unless the frame has been erased. The coefficients may be in differential LSP form, so a moving average of prior frames' decoded coefficients may be used. The LP coefficients may be interpolated every 40 samples in the LSP domain to reduce switching artifacts.

(2) Decode the adaptive codebook quantized pitch delay, and apply this pitch delay to the prior decoded (sub)frame's excitation to form the decoded adaptive codebook vector v(n). Again, the pitch delay is in layer 0.

(3) Decode the algebraic codebook vectors $c_0(n)$, $c_1(n)$, $c_2(n)$, . . . $c_N(n)$.

(4) Decode the quantized adaptive codebook gain, $g_p$, and the algebraic codebook gains $g_{c0}, g_{c1}, g_{c2}, g_{c3}, \ldots g_{CN}$.

(5) Form the excitation for the (sub)frame as $u(n)=g_P\ v(n)+g_{C0}\ c_0(n)+g_{C1}\ c_1(n)+g_{C2}\ c_2(n)+\ldots+g_{CN}\ c_N(n)$ using the decodings from steps (2)-(4).

(6) Synthesize speech by applying the LP synthesis filter from step (1) to the excitation from step (5) to yield $\hat{s}(n)$.

(7) Apply preferred embodiment short-term postfiltering to the synthesized speech with filter $P_S(z)=\hat{A}(z/\alpha_1)/\hat{A}(z/\alpha_2)$ to sharpen the formant peaks. The factors $\alpha_1$ and $\alpha_2$ depend upon the number of enhancement layers used, and as the number of enhancement layers increases the sharpening decreases. Of course, the short-term postfilter $P_S(z)$ has the same form as the perceptual weighting filter but does the opposite: it sharpens formant peaks because $\alpha_1<\alpha_2$ rather $\gamma_1>\gamma_2$ as in the PWF. Sharpened peaks tends to mask quantization noise.

The following table shows preferred embodiment $\alpha_1$ and $\alpha_2$ dependence on bit rates where layer 0 requires 6.25 kbps and each enhancement layer above layer 0 requires another 2.2 kbps.

| bitrate | $\alpha_1$ | $\alpha_2$ |
|---|---|---|
| 6.25 | 0.55 | 0.7 |
| 8.75 | 0.55 | 0.7 |
| 10.65 | 0.67 | 0.75 |
| 12.85 | 0.7 | 0.75 |
| 15.05 | 0.7 | 0.75 |
| 17.25 | 0.7 | 0.75 |

Figure 3C:
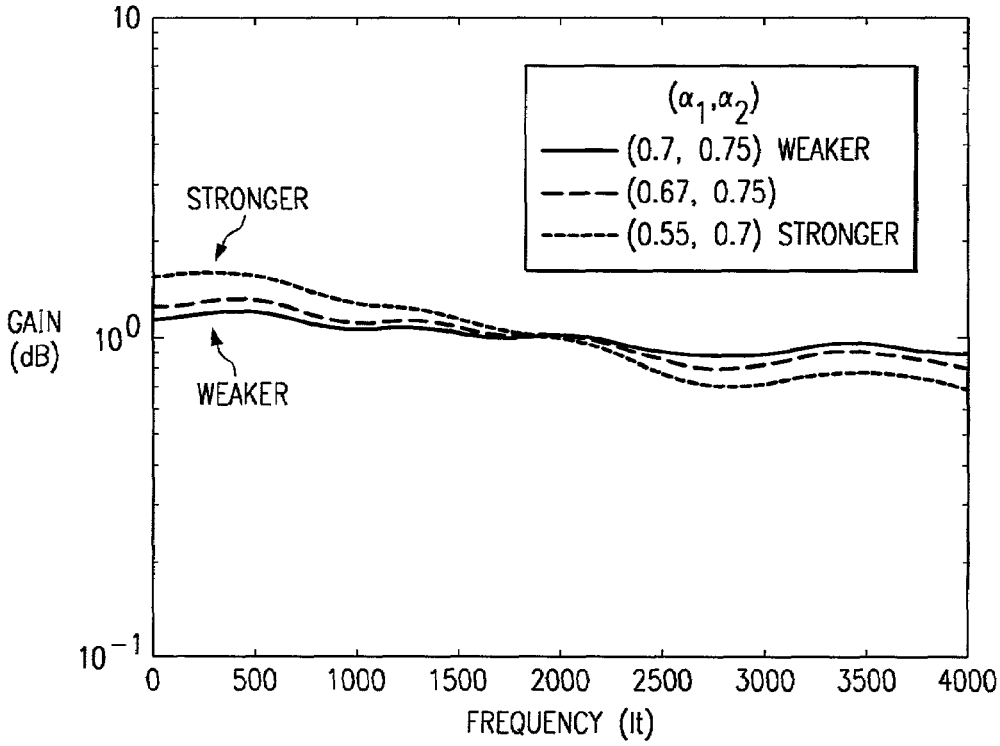

FIG. 3*c* illustrates these filters with the example of FIG. 3*a*. A weaker filter emphasizes large 1/A(z) less and suppresses small 1/A(z) less than a stronger filter which is the opposite of the PWFs previously described. Note the strength of a sharpening filter is the ratio $\alpha_2/\alpha_1$ in contrast to the ratio for a PWF.

(8) Apply preferred embodiment long-term postfiltering to the short-term postfiltered synthesized speech with filter $P_L(z)=(1+g\gamma z^{-T})/(1+g\gamma)$ where T is the pitch delay, g is the gain, and $\gamma$ is a factor controlling the degree of filtering and typically would equal 0.5. Filtering with $P_L(z)$ emphasizes periodicity and suppresses noise between pitch harmonic peaks. In more detail, the pitch delay T can be the decoded pitch delay from step (2) or a further refinement of the decoded pitch delay, and the gain can be derived from the refinement computations. Indeed, take the residual $\check{r}(n)$ to be the decoded estimate $\hat{s}(n)$ from step (6) filtered through $\hat{A}(z/\alpha_1)$, the analysis part of the short-term postfilter. Then search over fractional k about the integer part of the decoded pitch delay to maximize the correlation:

$$[\Sigma_n \check{r}(n)\check{r}_k(n)]^2/[\Sigma_n \check{r}_k(n)\check{r}_k(n)][\Sigma_n \check{r}(n)\check{r}(n)]$$

where $\check{r}_k(n)$ is $\check{r}(n)$ delayed by k and found by interpolation for non-integral k. If the correlation is less than 0.5, then take the gain g=0 so there is no long-term postfiltering because the periodicity is small. Otherwise, take $$g=\Sigma_n \check{r}(n)\check{r}_k(n)/\Sigma_b \check{r}_k(n)\check{r}_k(n)$$

This long-term postfilter applies to all bit rates (all numbers of enhancement layers) and compensates for the use of a single pitch determination in the base layer rather than in each enhancement layer.

4. System Preferred Embodiments

Figure 4:
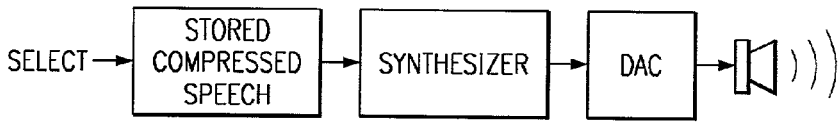
FIGS. 4-5 are block diagrams of systems.
Figure 5:
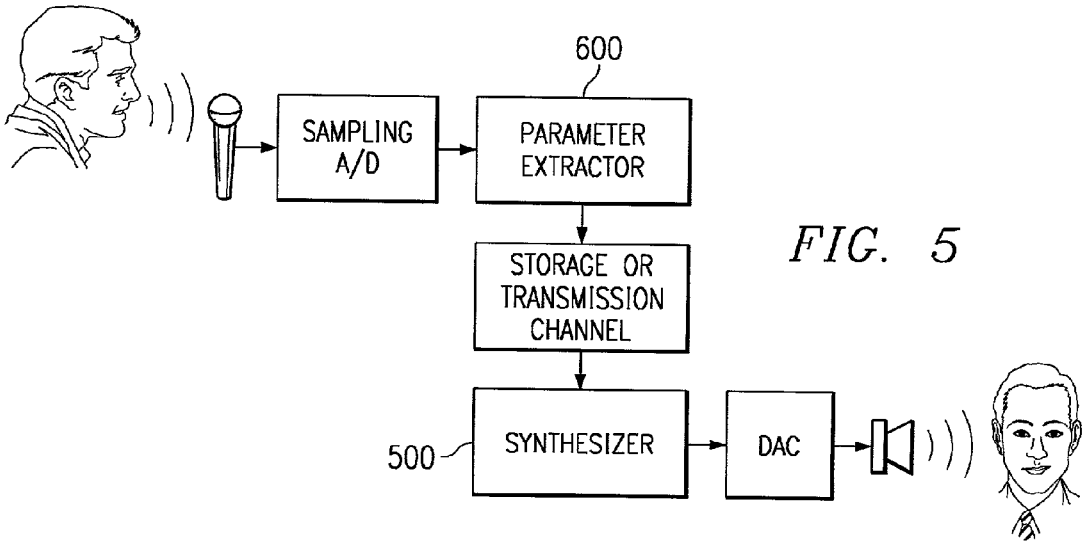

FIGS. 4-5 show in functional block form preferred embodiment systems which use the preferred embodiment encoding and decoding. The encoding and decoding can be performed with digital signal processors (DSPs) or general purpose programmable processors or application specific circuitry or systems on a chip such as both a DSP and RISC processor on the same chip with the RISC processor controlling. Codebooks would be stored in memory at both the encoder and decoder, and a stored program in an onboard or external ROM, flash EEPROM, or ferroelectric RAM for a DSP or programmable processor could perform the signal processing. Analog-to-digital converters and digital-to-analog converters provide coupling to the real world, and modulators and demodulators (plus antennas for air interfaces) provide coupling for transmission waveforms. The encoded speech can be packetized and transmitted over networks such as the Internet.

5. Modifications

The preferred embodiments may be modified in various ways while retaining the features of layered coding with encoders having a weaker perceptual filter for at least one of the enhancement layers than for the base layer, decoders having weaker short-term postfiltering for at least one enhancement layer than for the base layer, or decoders having long-term postfiltering for all layers.

For example, the overall sampling rate, frame size, LP order, codebook bit allocations, prediction methods, and so forth could be varied while retaining a layered coding. Further, the filter parameters $\gamma$ and $\alpha$ could be varied while enhancement layers are included provided filters maintain strength or weaken for each layer for the layered encoding and/or the short-term postfiltering. The long-term postfiltering could have the correlation at which the gain is taken as zero varied and its synthesis filter factor $\gamma_1$ could be separately varied.

What is claimed is:

1. A layered encoding, comprising:

(a) means for applying a base layer perceptual filter to a signal to yield a base layer filtered signal;

(b) means for finding a base layer estimate for said signal by base layer error minimization with said base layer filtered signal; and (c) means for finding a first enhancement layer estimate for said signal by error minimization with a first enhancement layer perceptual filter applied to a error in said base layer after inverse filtering with said base layer perceptual filter, (d) for j=2, . . . , N, means for finding a jth enhancement layer estimate for said signal by error minimization with a jth enhancement layer perceptual filter applied to an error in said (j−1)st enhancement layer after inverse filtering with said (j−1)st enhancement layer perceptual filter, wherein at least one of said jth enhancement layer perceptual filters is weaker than said base layer perceptual filter.

2. The layered encoding of claim 1, wherein:

(a) said estimates are synthesis filtered CELP excitations.

* * * * *

UNITED STATES PATENT AND TRADEMARK OFFICE

CERTIFICATE OF CORRECTION

PATENT NO. : 7,606,703 B2
APPLICATION NO. : 10/054604
DATED : October 20, 2009
INVENTOR(S) : Takahiro Unno It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1107 days.

Signed and Sealed this

Fourteenth Day of December, 2010

David J. Kappos

David J. Kappos
*Director of the United States Patent and Trademark Office*